US008713942B2

(12) United States Patent
Ramaswamy et al.

(10) Patent No.: US 8,713,942 B2
(45) Date of Patent: May 6, 2014

(54) SYSTEM AND METHOD FOR EQUILIBRATING AN ORGANIC RANKINE CYCLE

(75) Inventors: Sitaram Ramaswamy, West Hartford, CT (US); Sean P. Breen, Holyoke, MA (US)

(73) Assignee: United Technologies Corporation, Hartford, CT (US)

( * ) Notice: Subject to any disclaimer, the term of this patent is extended or adjusted under 35 U.S.C. 154(b) by 1042 days.

(21) Appl. No.: 12/696,392

(22) Filed: Jan. 29, 2010

(65) Prior Publication Data

US 2011/0185734 A1 Aug. 4, 2011

(51) Int. Cl.
*F01K 25/08* (2006.01)
*F01B 31/16* (2006.01)

(52) U.S. Cl.
USPC ..... 60/651; 60/660; 60/671; 60/685

(58) Field of Classification Search
USPC ..... 60/649, 651, 671, 660, 685
See application file for complete search history.

(56) References Cited

U.S. PATENT DOCUMENTS

| | | | | |
|---|---|---|---|---|
| 5,113,927 | A * | 5/1992 | Kedar et al. | 165/278 |
| 5,119,635 | A | 6/1992 | Harel | |
| 5,720,177 | A * | 2/1998 | Derrick et al. | 62/115 |
| 6,962,056 | B2 * | 11/2005 | Brasz et al. | 60/772 |
| 7,100,380 | B2 | 9/2006 | Brasz et al. | |
| 7,174,716 | B2 | 2/2007 | Brasz et al. | |
| 7,594,399 | B2 * | 9/2009 | Lehar et al. | 60/649 |
| 2005/0171736 | A1 | 8/2005 | Kang | |
| 2009/0199557 | A1 * | 8/2009 | Bennett | 60/641.15 |

FOREIGN PATENT DOCUMENTS

WO WO-2008153517 A2 12/2008

* cited by examiner

*Primary Examiner* — Hoang Nguyen
(74) *Attorney, Agent, or Firm* — Miller, Matthias & Hull LLP

(57) ABSTRACT

Embodiments of an ORC system can be configured to reduce ingress of contaminants from the ambient environment. In one embodiment, the ORC system can comprise a pressure equilibrating unit that comprises a variable volume device for holding a working fluid. The variable volume device can be fluidly coupled to a condenser so that working fluid can move amongst the condenser and the variable volume device. This movement can occur in response to changes in the pressure of the working fluid in the ORC system, and in one example the working fluid is allowed to move when the pressure deviates from atmospheric pressure.

13 Claims, 4 Drawing Sheets

SYSTEM AND METHOD FOR EQUILIBRATING AN ORGANIC RANKINE CYCLE

TECHNICAL FIELD

The present invention relates generally to Organic Rankine Cycle ("ORC") systems, and in one particular embodiment to such ORC systems that reduce contamination of the working fluid by maintaining pressure of the working fluid in the system.

BACKGROUND

ORC systems are generally well-known and commonly used for the purpose of generating electrical power that is provided to a power distribution system or grid for residential and commercial use across the country. These systems implement a vapor power cycle that utilizes an organic fluid as the working fluid instead of water/steam. Functionally these ORC systems resemble the steam cycle power plant, in which a pump increases the pressure of the condensed working fluid, the condensed working fluid is vaporized, and the vaporized working fluid interacts with a turbine to generate power.

Notably the ORC systems are generally closed-loop systems. However, systems of this type are particularly sensitive to changes in internal pressure because such changes can permit ingress of contaminants into the working fluid. These contaminants can not only reduce the efficiency of the ORC system, but also cause damage to one or more of the components that are used to implement the ORC cycle. Repairs, maintenance, and general cleaning of the system can be costly, as the ORC system must be taken off-line and thus no longer generates power that can be provided to the energy grid.

To avoid some issues of contamination, certain approaches utilize various forms of purge systems, which are fluidly coupled to the ORC system. These purge systems are typically configured to extract the working fluid from the ORC system, remove contaminants from the working fluid, and reintroduce the "clean" working fluid back into the ORC system. However, while this approach does address the issue of contamination, the purge systems require infrastructure, circuitry, and general structure that must be provided in addition to the components of the ORC system. This additional equipment can add cost and maintenance time to the ORC system. Moreover, the purge systems generally do not address the source of the contamination which is the ingress of contaminated fluids, such as air from the environment that surrounds the closed-loop ORC system.

There is therefore a need for an ORC system and method that can reduce the likelihood of the ingress of such contaminated air to address the issue of contamination in ORC systems at the source of the problem. There is likewise a need for solutions to the contamination issue that do not require the addition to the ORC system of substantially new equipment, costs, and control infrastructure.

SUMMARY

There is described below embodiments in accordance with the present invention that can maintain the pressure within ORC system to reduce the ingress of fluids such as gases from the environment.

There is provided in one embodiment a system operating as an Organic Rankine Cycle system in an ambient environment. The system can comprise an integrated system having in serial flow relationship a pump, a vapor generator, a turbine, and a condenser. The system can also comprise a variable volume device in fluid communication with the condenser. The system can further be described wherein the volume changes from a first volume to a second volume in response to a change in the pressure of the integrated system.

There is also provided in another embodiment a method of equilibrating the pressure of a system for performing an Organic Rankine Cycle. The method can comprise a step for integrating in serial flow relation a pump, a vapor generator, a turbine, and a condenser. The method can also comprise a step for coupling in fluid communication a variable volume device to the condenser. The method can further comprise a step for changing the amount of condensed working fluid in the variable volume device in response to a change in the pressure of said system.

BRIEF DESCRIPTION OF THE DRAWINGS

So that the manner in which the above recited features of the present invention can be understood in detail, a more particular description of the invention briefly summarized above, may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Moreover, the drawings are not necessarily to scale, emphasis generally being placed upon illustrating the principles of certain embodiments of invention.

Thus, for further understanding of the concepts of the invention, reference can be made to the following detailed description, read in connection with the drawings in which.

DETAILED DESCRIPTION

In accordance with its major aspects and broadly stated, embodiments of the present invention are directed to systems and methods for equilibrating the pressure of a working fluid in power generating systems such as those systems implementing (and/or operating) as an ORC system. There is provided in the discussion below, for example, embodiments of such systems that are configured to maintain, or limit deviations in, the pressure of the working fluid in a manner that can substantially reduce ingress of, e.g., air, that is found outside of the system. This response can effectively prevent contaminants and other materials (including solids, gases, and liquids) that are deleterious to the operation of the system from mixing with the working fluid. This feature is particularly beneficial because the inventors have discovered that unlike the systems discussed in the Background above, which must purge all of the working fluid to remove such contamination, the systems of the present embodiments not only reduce the likelihood of contamination that can result from pressure variations in the system, but also can maintain operation without the need to interfere with the system to address such contamination.

Figure 1:
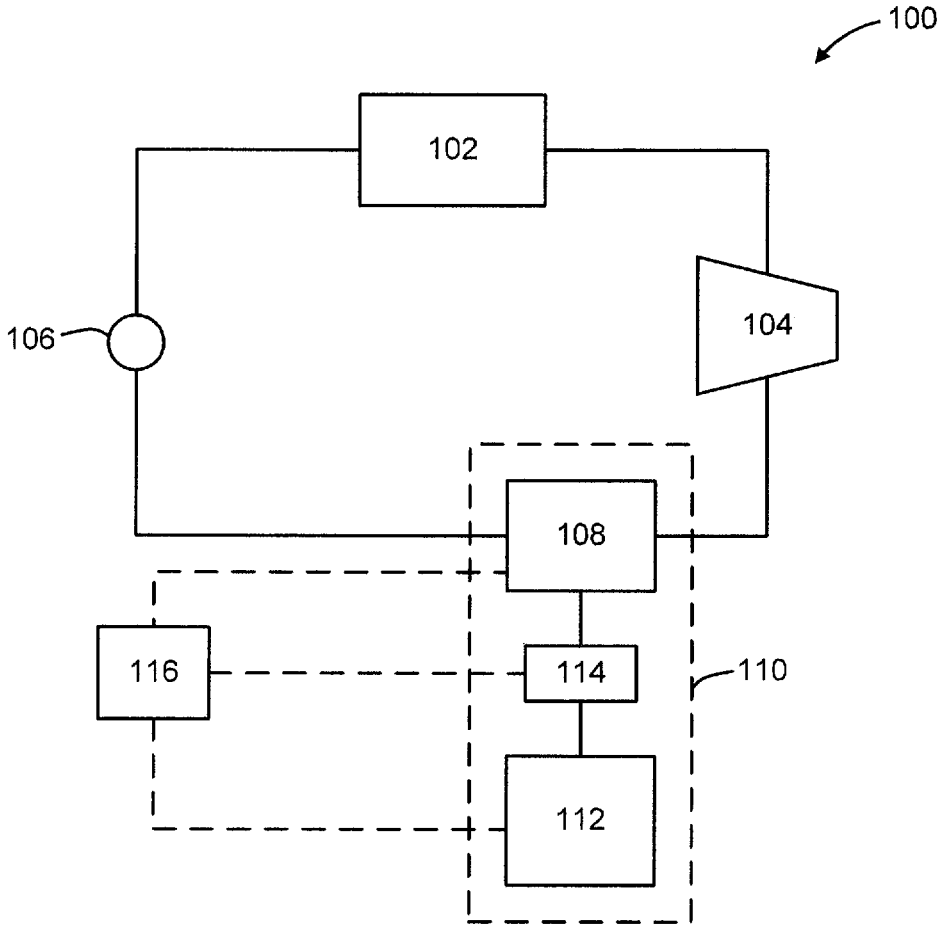
FIG. 1 is a schematic diagram of an example of an ORC system that is made in accordance with concepts of the present invention.

Referring now to FIG. 1, there is shown a schematic illustration of an ORC system 100 that is made in accordance with concepts of the present invention. Those familiar with ORC systems will generally recognized that a working fluid (not shown) such as a refrigerant (e.g., water, R245fa) can be provided in the ORC system 100. This working fluid flows amongst the various components of the ORC system, some of which are discussed in more detail below. The components are typically coupled together as closed-loop systems, which are substantially hermetically sealed from the environment (hereinafter "the ambient environment"). This implementation of the components is designed to maintain the pressure, temperature, and other parameters of the working fluid irrespective of the parameters of the ambient environment around the ORC system 100.

In one embodiment, the ORC system 100 can comprise a vapor generator 102, a turbine generator 104, a pump 106, and a condenser 108. The ORC system 100 can further comprise a pressure equilibrating unit 110, which in one particular construction can have as components the condenser 108, a variable volume device 112, and a valve unit 114 that is coupled to the condenser 108 and the variable volume device 112. A control unit 116 can be coupled to one or more of the valve unit 114, the variable volume device 112, as well as other portions of the ORC system 100 as desired, and as exemplified in the discussion further below.

Related to the operation of systems such as the ORC system 100, the vapor generator 102, which is commonly a boiler having significant heat input to the working fluid, vaporizes the working fluid. The working fluid vapor that results is passed to the turbine generator 104 to provide motive power to the turbine generator 104. Upon leaving the turbine generator 104, the working fluid vapor passes next to the condenser 108 wherein the working fluid vapor is condensed by way of heat exchange relationship with a cooling medium (not shown). The working fluid vapor, now condensed, is then circulated to the vapor generator 102 by the pump 106, which essentially completes the cycle of the ORC system 100.

Focusing on the pressure equilibrating unit 110, the variable volume device 112 can be configured to accommodate an amount of the working fluid. This amount can vary such as, for example, due to the changes in the pressure of working fluid in the ORC system 100. In one example, the variable volume device 112 can be provided as a bellows, balloon, and similar device with a volume that can expand and contract to accommodate more or less working fluid as required. These devices can be variously constructed from expandable and/or flexible materials that are compatible with the working fluid, as well as being resilient to the pressure and temperatures of the working fluid within the ORC system 100. Examples of such materials can include, but are not limited to, ERA 7810, ERA 7815, GN 807, Neopren/Hypalon 2012, Nylon-PU, OZ 23, OZ 35, OZ PUR, Perl X 10, VB 42, Monel 400, Inconel 600, and Stainless Steel 316, among many others.

The valve unit 114 can be positioned to receive the working fluid from both the condenser 108 and the variable volume device 112. The valve unit 114 can be configured to meter this flow of the working fluid such as in response to changes in the pressure of the working fluid in the ORC system 100. The valve unit 114 can also operate in and amongst a plurality of states. These states can correspond to the changes in the pressure of the working fluid in the ORC system 100. Based on these changes, the valve unit 114 can operate to prevent or to permit the flow of the working fluid as between the condenser 108 and the variable volume device 112.

The control unit 116 can also facilitate operation of the valve unit 114, such as by providing a control to the valve unit 114. This control can be in the form of an electrical signal or other indicator that is selected to change the valve unit 114 such as between the open and closed states discussed above. The control unit 116 can interface with sensors, probes, and the like to monitor one or more parameters of the working fluid. Deviations from certain established parameters such as a set point pressure can cause the control unit 116 to provide the control, which can influence the operation of the valve unit 114. The set point pressure can be set to the value of the pressure of the ambient environment, with the set point pressure of one embodiment of the ORC system 100 being set to about atmospheric pressure.

Discussing the operation of one exemplary embodiment of the ORC system 100, the valve unit 114 can fluidly couple the condenser 108 to the variable volume device 112. When the pressure of the working fluid in the condenser 108 drops below atmospheric pressure, the valve unit 114 can change to an open state in which working fluid moves from the variable volume device 112 to the condenser 108. This flow can re-equilibrate the pressure in the condenser 108, at which point the valve unit 114 can change to a closed state, which effectively stops the flow of the working fluid.

Figure 2:
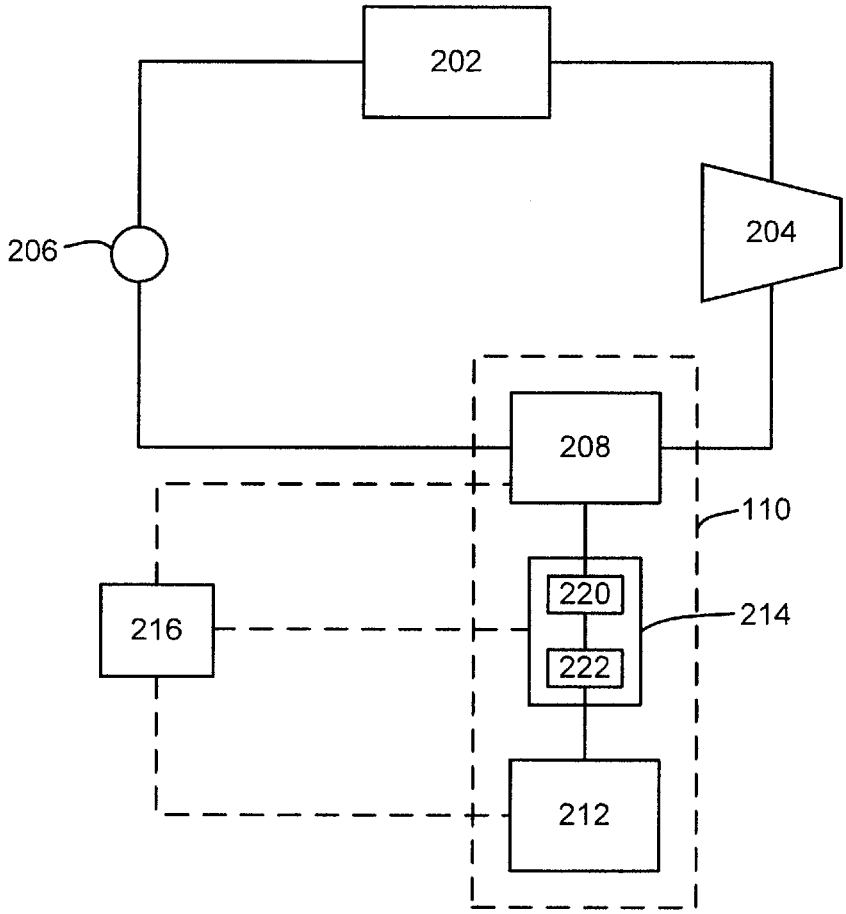
FIG. 2 is a schematic diagram of another example of an ORC system that is made in accordance with concepts of the present invention.

Another embodiment of an ORC system 200 can be had with reference to the schematic diagram illustrated in FIG. 2. Like the example of FIG. 1, the ORC system 200 can also comprise a vapor generator 202, a turbine generator 204, a pump 206, a condenser 208, as well as a pressure equilibrating unit 210 with a variable volume device 212 and a valve unit 214. There can be likewise provided a control unit 216 in the ORC system 200, which in the present example can be coupled variously to the ORC system 200.

By way of non-limiting example, and with particular reference to the pressure equilibrating unit 210, the valve unit 214 can comprise one or more valves 218 such as the pressure equilibrating valve 220 and the flow control valve 222. Typically the valves 218 are sized and configured to permit adequate flow, temperature, and pressure of the working fluid in the ORC system 200. Examples of valves that can be used include, but are not limited, solenoid valves, check valves, gate valves, globe valves, diaphragm valves, pressure relief valves, plug valve, and similar devices that can be used to control the flow of fluids, e.g., the working fluid. Moreover, while each of the valves 218 are illustrated as being single devices, there is further contemplated embodiments of the present invention that employ more than one of, e.g., the pressure equilibrating valve 220 and the flow control valve 222 to instantiated the valve unit 214. Combinations of various valves, tubing, manifolds, and the like can be used, for example, to meter the flow of the working fluid amongst the condenser 208 and the variable vacuum device 212.

In one embodiment, the pressure equilibrating valve 220 and the flow control valve 222 can open and close to control the flow of fluid into and out of the variable volume device 212. The flow can be controlled based on changes in the pressure of the working fluid. In one example, these valves can have an actuatable interface (e.g., the solenoid of a solenoid valve), which can be activated, e.g., by the control, in response to conditions when the pressure in the condenser drops below atmospheric pressure. In one example, the activation of the actuatable interface can open the pressure equilibrating valve 220 and permit the working fluid to fill the variable volume device 212. In another example, the actuatable interface can also be activated, e.g., by the control, in response to conditions when the amount of working fluid in the variable volume device 212 reaches a pre-determined level such as a minimum volume limit and a maximum volume limit, as discussed in connection with the methods of FIGS. 3 and 4. These methods illustrate one or more exemplary operations of embodiments of the ORC systems 100, 200 described below.

Figure 3:
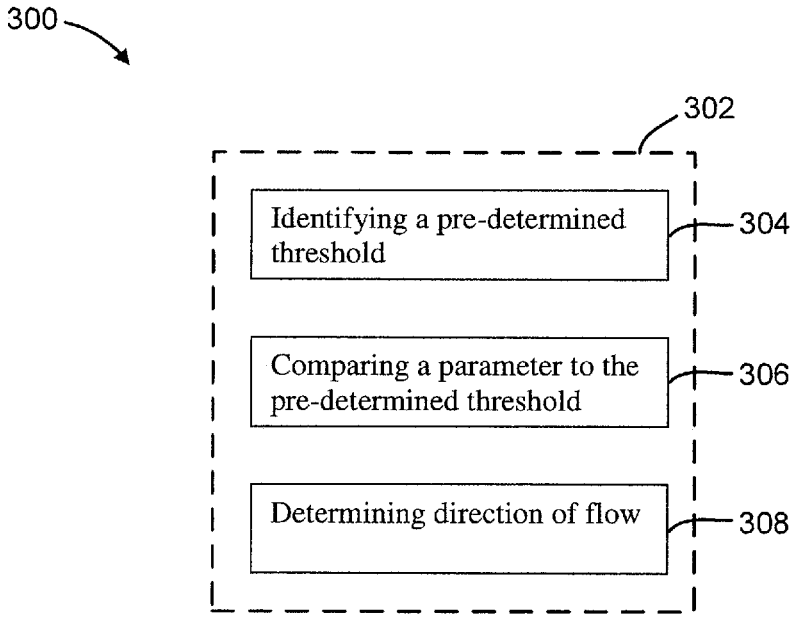
FIG. 3 is a flow diagram of a method of operating an ORC system, such as the ORC systems of FIGS. 1 and 2.

With reference now to FIG. 3, and also to FIG. 2, there is illustrated an example of a method 300 for equilibrating pressure in an ORC system, such as the ORC system 100, 200 discussed above. The method 300 can comprise general operating steps 302, which can comprise a variety of steps 304-308, some of which are useful for particular operations and processes of the ORC system. In the present example, the method 300 can comprise, at step 304, identifying a predetermined threshold such as the set point pressure, at step 306, comparing a parameter such as pressure of the working fluid in the condenser ("the condenser pressure") to the predetermine threshold, and at step 308, determining the direction of flow of the working fluid based on the comparison.

The steps 304-308 illustrate at a high level one operation of the ORC systems of the present invention. The direction of flow, for example, can comprise a direction wherein the working fluid moves from the condenser (and/or ORC system) toward the variable volume device. This direction may correspond to conditions in which the condenser pressure drops below atmospheric pressure. The direction of flow can also comprise a direction wherein the working fluid moves from the variable volume device toward the condenser (and/or ORC system). This direction may correspond to conditions in which the condenser pressure is greater than atmospheric pressure.

Figure 4:
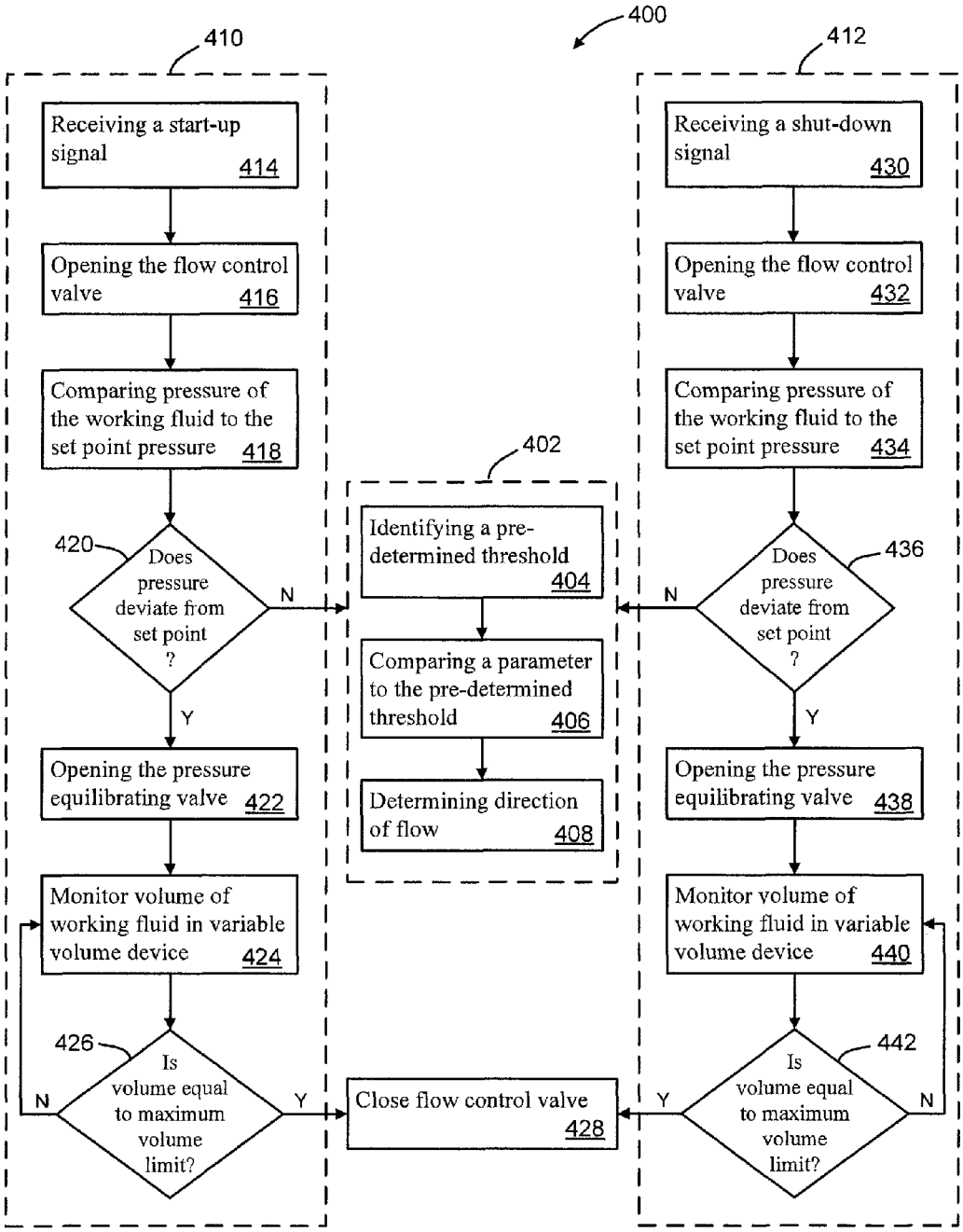
FIG. 4 is a flow diagram of another method of operating an ORC system, such as the ORC systems of FIGS. 1 and 2.

For a more detailed operation of ORC systems such as the ORC systems 100, 200, reference can now be had to the method 400 that is illustrated in FIG. 4 and described below. In this example, and like the method 300 described above, the method 400 can comprise general operating steps 402, which can comprise at step 404 identifying a pre-determined threshold such as the set point pressure, at step 406, comparing a parameter such as the condenser pressure to the pre-determine threshold, and at step 408, determining the direction of flow of the working fluid based on the comparison.

Moreover, the method 400 can comprise start-up operating steps 410 and shut-down operating steps 412. Each of the operating steps 402, 410 and 412 can be implemented together as part of the operative configuration of the ORC system. In other embodiments of the ORC system, one or more of the operating steps 402, 410, and 412 can be implemented separately or as part of different operating procedures and processes for the ORC system.

Discussing first the start-up operating steps 410 for the ORC system, there is shown in the FIG. 4 that the method 400 can comprise at step 414 receiving a startup completed signal, and at step 416 opening the flow control valve. The method can further comprise at step 418 comparing the pressure of the working fluid at the condenser to the set point pressure, and in one example the set point pressure is atmospheric pressure. The method can also comprise at step 420 determining whether the condenser pressure deviates from the set-point pressure, and in one particular implementation the method 400 comprises, at step 422, opening the pressure equilibrating valve in response to conditions in which the condenser pressure is greater than the set point pressure. The working fluid can then flow from the condenser toward the variable volume device.

In one embodiment, the method 400 can comprise at step 424 monitoring the amount of working fluid in the variable volume device, and also at step 426 determining whether the amount has reached a volume limit for the variable volume device such as the maximum volume limit and the minimum volume limit discussed above. One exemplary method 400 can also comprise at step 428 closing the flow control valve when the amount reaches the maximum volume limit. This step 428 stops the movement of the working fluid from the condenser to the variable volume device.

Referring next to the shut-down operating steps 412, there is shown in FIG. 4 that the method 400 can comprise, at step 430, receiving a shutdown complete signal, and at step 432, opening the flow control valve. The method 400 can further comprise at step 434 comparing the pressure of the working fluid at the condenser to the set point pressure. The method can also comprise at step 436 determining whether the condenser pressure deviates from the set-point pressure, and in one particular implementation the method 400 comprises, at step 438, opening the pressure equilibrating valve in response to conditions in which the condenser pressure is less than the set point pressure. The working fluid can then flow from the variable volume device toward the pressure condenser.

In one embodiment, the method 400 can comprise at step 440 monitoring the amount of working fluid in the variable volume device, and also at step 442 determining whether the amount has reached the volume limit for the variable volume device. One exemplary method 400 can go to step 428 closing the flow control valve when the amount reaches the minimum volume limit. This step 428 stops the movement of the working fluid from the condenser to the variable volume device.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

While the present invention has been particularly shown and described with reference to certain exemplary embodiments, it will be understood by one skilled in the art that various changes in detail may be effected therein without departing from the spirit and scope of the invention as defined by claims that can be supported by the written description and drawings. Further, where exemplary embodiments are described with reference to a certain number of elements it will be understood that the exemplary embodiments can be practiced utilizing either less than or more than the certain number of elements.

What is claimed is:

1. A system operating as an Organic Rakine Cycle system in an ambient environment, said system comprising:

an integrated system having in serial flow relationship a pump, a vapor generator, a turbine, and a condenser; and a pressure equilibrating unit in fluid communication with the condenser, the pressure equilibrating unit comprising:

a variable volume device having volume in fluid communication with the condenser, wherein the volume changes from a first volume to a second volume in response to a change in the pressure of the integrated system, wherein the variable volume device comprises a bellow that receives a condensed working fluid therein, and wherein the bellows comprises a flexible material that expands to accommodate at least one of the first volume and the second volume.

2. A system according to claim 1, wherein the variable volume device is directly coupled to the condenser.

3. A system according to claim 1, wherein the pressure equilibrating unit further comprises a valve unit coupled to the condenser and the variable volume device, wherein the valve unit changes amongst a plurality of states in response to the change in pressure, and wherein the volume changes from the first volume to the second volume in response to the change in the state of the valve unit.

4. A system according to claim 1, wherein the volume change results from a drop in the pressure of the integrated system below a set point pressure.

5. A system according to claim 4, wherein the set point pressure is about the pressure of the ambient environment.

6. A system according to claim 1, wherein the pressure equilibrating unit further comprises:

a pressure equalization valve responsive to the change in pressure; and a flow control valve responsive to a volume limit for the variable volume device, wherein the volume limit is a function of the amount of condensed working fluid in the variable volume device.

7. A system according to claim 6, wherein the volume limit comprises a minimum volume limit and a maximum volume limit.

8. A method of equilibrating the pressure of a system for performing an Organic Rakine Cycle, said method comprising:

integrating in serial flow relation a pump, a vapor generator, a turbine, and a condenser;

coupling in fluid communication a pressure equilibrating unit to the condenser, the pressure equilibrating unit comprising a variable volume device, wherein the variable volume device comprises a bellows that expands to accommodate the amount of condensed working fluid in the variable volume device; and changing the amount of condensed working fluid in the variable volume device in response to a change in the pressure of said system.

9. A method according to claim 8, further comprising flowing the working fluid between the condenser and the variable volume device through a valve unit, wherein the change in pressure causes the valve unit to actuate from a first state to a second state, and wherein the amount of condensed working fluid in the variable volume device in the first state is less than the amount of condensed working fluid in the variable volume device in the second state.

10. A method according to claim 9, wherein the pressure in the second state is less than a set point pressure, and wherein the set point pressure is at least about atmospheric pressure.

11. A method according to claim 8, further comprising:

measuring the amount of condensed working fluid in the variable volume device; and metering the flow of the condensed working fluid from the variable volume device based on the amount of the condensed working fluid.

12. A method according to claim 11, wherein the condensed working fluid flows through a flow control valve, and wherein the flow control valve is responsive to a control that identifies the amount.

13. A method according to claim 12, wherein the amount comprises a minimum volume and a maximum volume limit.

* * * * *